US005201164A

United States Patent [19]

Kaufman

[11] Patent Number: 5,201,164

[45] Date of Patent: Apr. 13, 1993

[54] METHOD FOR IMPROVING THE DISPENSING OF STACKED WET WIPES

[75] Inventor: David P. Kaufman, Appleton, Wis.

[73] Assignee: Kimberly-Clark Corporation, Neenah, Wis.

[21] Appl. No.: 702,641

[22] Filed: May 17, 1991

[51] Int. Cl.[5] ..... B65B 1/24

[52] U.S. Cl. ..... 53/436; 53/431

[58] Field of Search ..... 100/35; 206/210, 494, 206/812; 53/431, 436, 438, 523, 527

[56] References Cited

U.S. PATENT DOCUMENTS

| | | | |
|---|---|---|---|
| 3,172,564 | 3/1965 | Enloe et al. | 206/494 X |
| 3,634,183 | 1/1972 | Viola et al. | 206/210 X |
| 3,780,908 | 12/1973 | Fitzpatrick et al. | 206/494 X |
| 3,805,474 | 4/1974 | Gerstein | 53/431 X |
| 4,189,896 | 2/1980 | Kolbach et al. | 53/436 X |
| 4,577,453 | 3/1986 | Hofeler | 53/438 |
| 4,649,695 | 3/1987 | Crouch et al. | 53/431 |
| 4,743,327 | 5/1988 | DeHaan et al. | 156/272.6 |
| 4,756,141 | 7/1988 | Hirsch et al. | 53/438 |

*Primary Examiner*—John Sipos
*Assistant Examiner*—Daniel B. Moon
*Attorney, Agent, or Firm*—Gregory E. Croft

[57] ABSTRACT

In the manufacture of wet wipes, compressing the wet wipe stack within the container prior to sealing the container improves one-at-a-time dispensing of the wipes, e.g. the tendency for certain wipes to stick together upon removal is reduced.

8 Claims, 3 Drawing Sheets

METHOD FOR IMPROVING THE DISPENSING OF STACKED WET WIPES

BACKGROUND OF THE INVENTION

Wet wipes, such as baby wipes, are typically packaged in a plastic container or tub containing a stack of wipes. To remove an individual wipe from the tub, the lid is opened and the user reaches in and grasps and removes the top wipe from the stack. The wipes are packaged in a variety of choices regarding the number of wipes within the tub. Some current products contain as few as 16 wipes, while others contain as many as 128, depending on the consumer demand for the different sizes. Regardless of the number of wipes within the stack, a common complaint centers around the tendency for some wipes to stick together, resulting in the removal of two wipes instead of one, or failure of the wipe to dispense in a fully-open condition which requires the user to unfold the wipe before use. These are sources of aggravation for the user, particularly when reaching for a baby wipe with one hand and trying to manage a squirming infant with the other.

SUMMARY OF THE INVENTION

During manufacture of stacks of wet wipes within a container, the stack is commonly formed by combining multiple clips of from about four to eight wet wipes per clip. Each clip of wipes is separately wetted and thereafter combined to form a stack of the desired number of wet wipes. The stack is placed into the dispensing container or tub and sealed.

Applicant has found that within a stack of wipes comprising multiple clips of wipes, there is greater adhesion between adjacent wipes within a given clip than there is between the bottom wipe of one clip and the top wipe of the clip below. Consequently during dispensing, when the second to-last wipe of each clip is removed, the last wipe of the clip often sticks to it and is also removed. It has been found that this tendency to dispense two wipes at a time can be substantially reduced by compressing the entire wet wipe stack. While not being bound to any particular theory, it is believed that compression causes the moisture within the wet wipes to equilibrate from clip to clip. This in turn equalizes the wipe-to-wipe adhesion throughout the stack.

Accordingly, the invention resides in an improved method for making a stack of wet wipes comprising the steps of forming two or more individual clips of wet wipes and combining the individual clips into a stack of wet wipes, the improvement comprising compressing the stack of wet wipes sufficiently to increase the degree of adhesion between adjacent wipes of adjacent clips. The amount of compression will depend upon a number of variables, including the number of wipes within the stack, the amount of moisture within the wipes, the nature of the wet wipe basesheet, etc. However, it is preferred that the amount of compression be about 0.5 pounds per square inch or greater, more preferably about 1.8 pounds per square inch or greater, still more preferably about 2.6 pounds per square inch or greater, and most preferably about 3.5 pounds per square inch or greater. The objective is to improve the wipe-to-wipe adhesion such that the stack behaves more like a single clip rather than an assembly of multiple clips. In applying the compression, a countervailing consideration is that the compression should not express the liquid from the stack to the extent that the expressed liquid remains pooled in the bottom of the container. Whether or not this is a concern will depend on the nature of the basesheet and its ability to reabsorb the liquid, the amount of liquid remaining within the stack, and the economics of the wasted solution which is not reabsorbed. This aspect must be optimized to fit the particular circumstances.

DETAILED DESCRIPTION OF THE DRAWINGS

Figure 1:
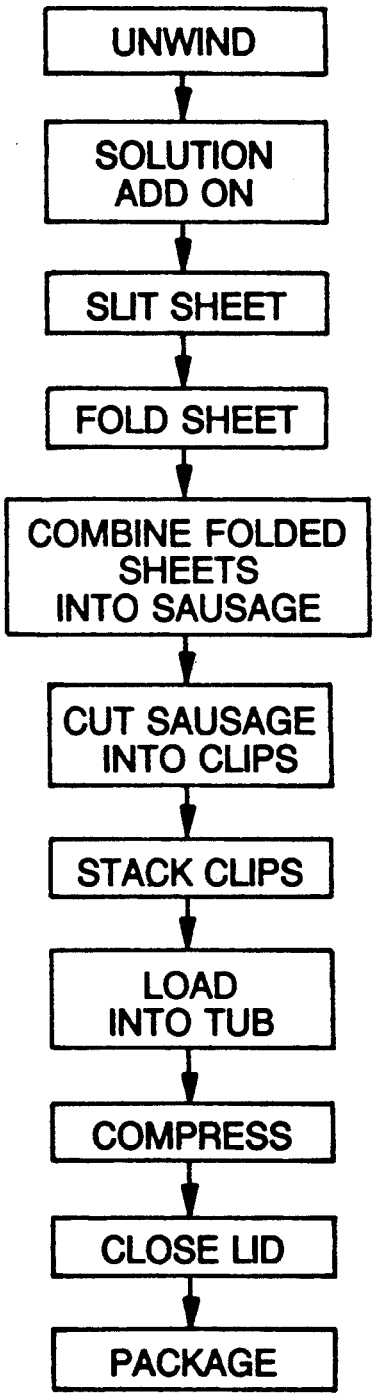
FIG. 1 is a block flow diagram of a wet wipe manufacturing process, illustrating an example of how the compression of the stack of wipes in accordance with this invention relates to the overall method of making wipes.

Referring to the drawing, the invention will be described in greater detail. FIG. 1 illustrates the several method steps which can be used to make wet wipes and how the method of this invention fits into the overall process. The particular process and sequence of steps described is not a limitation on the method of this invention, but is disclosed only as one example of a wet wipe process to which the method of this invention is applicable. Those skilled in the art of wet wipe manufacture will appreciate that many other processes and step sequences can also be employed.

Initially, a supply roll of the basesheet to be converted into wet wipes is unwound. The basesheet can be any web suitable for use as a wet wipe, including meltblown, coform, airlaid, bonded-carded web, and the like and can comprise synthetic or natural fibers or combinations thereof. A preferred basesheet is a coform basesheet of polypropylene and cellulose fibers having a basis weight of about 70 grams per square meter and manufactured generally as described in U.S. Pat. No. 4,100,324 to Anderson et al. dated Jul. 11, 1978, which is herein incorporated by reference. The basesheet is then saturated or otherwise impregnated with the wet wipe solution by any suitable means such as spraying, dipping, or the like. A particularly suitable method is to pass the basesheet over several perforated tubes which exude the solution into the basesheet. Add-on levels of solution can range from about 100 to about 700 weight percent, based on the dry weight of the basesheet, with an add-on of from about 300 to about 350 weight percent being preferred. The preferred amount will depend greatly on the nature of the basesheet.

After the basesheet has been impregnated with the desired amount of liquid, the basesheet is slit in the machine direction into multiple ribbons, each of which is folded into the type of fold to be exhibited by the individual wipes. By way of example, the basesheet can be slit into eight ribbons and folded into a z-fold configuration. Each z-folded ribbon is then combined, one ribbon on top of the other, with the other seven z-folded ribbons from the same basesheet to form a continuous "sausage". The sausage is then cut into "clips" of eight wipes apiece and the clips of wipes are combined to form a "stack". The number of clips in a stack depends on the number of wipes in the final product. For a 120 count package, fifteen clips of eight wipes apiece would be required to form a stack of 120 wipes.

After formation of the stack of wipes, the stack is placed into the dispensing container, commonly referred to as a tub. At this stage the stack is compressed in accordance with this invention to unify the stack and minimize the tendency of the stack to act like an accumulation of individual clips. After compression of the stack, the lid of the tub is closed and the tub is further packaged as desired.

Figure 2:
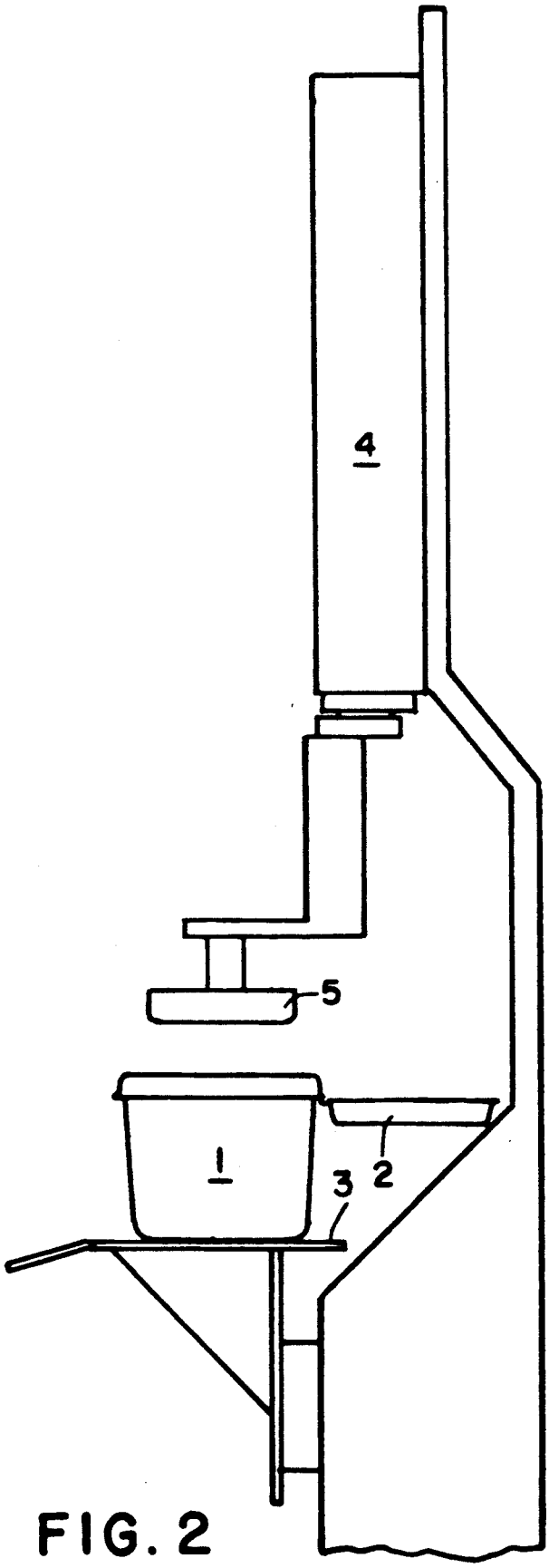
FIG. 2 is a schematic view of the compression step of this invention, illustrating the nature of one type of apparatus useful for compressing the wet wipe stack.

FIG.2 illustrates a preferred means of compressing the stack in accordance with this invention. Shown is a tub 1 with its lid 2 open and which contains a stack of wet wipes. The tub is appropriately supported on a surface 3. A suitably mounted pneumatic cylinder 4 is connected to a compression foot 5, which is positioned to move up and down and compress the stack of wipes within the tub. The shape of the foot is generally rectangular and the size of the foot is preferably only slightly smaller than the opening of the tub, thereby substantially covering the entire surface of the top of the stack. It has been found that a suitable size is 3×6 inches for a stack of wipes measuring 3.8×7.6 inches as viewed from the top of the stack. However, other shapes and sizes can also be effectively employed. It is also preferable that the surface of the compression foot which contacts the wipes have a roughened or bumpy surface to minimize or eliminate any tendency of the wipes to stick to the compression foot after the stack has been compressed. A suitable surface is a plasma coated surface (No. 936, Plasma Coating Company, Waterbury. Ct). While overall compression of the surface of the stack is preferred, suitable results can also be achieved with more limited or selective compression in terms of the surface area actually compressed.

Figure 3:
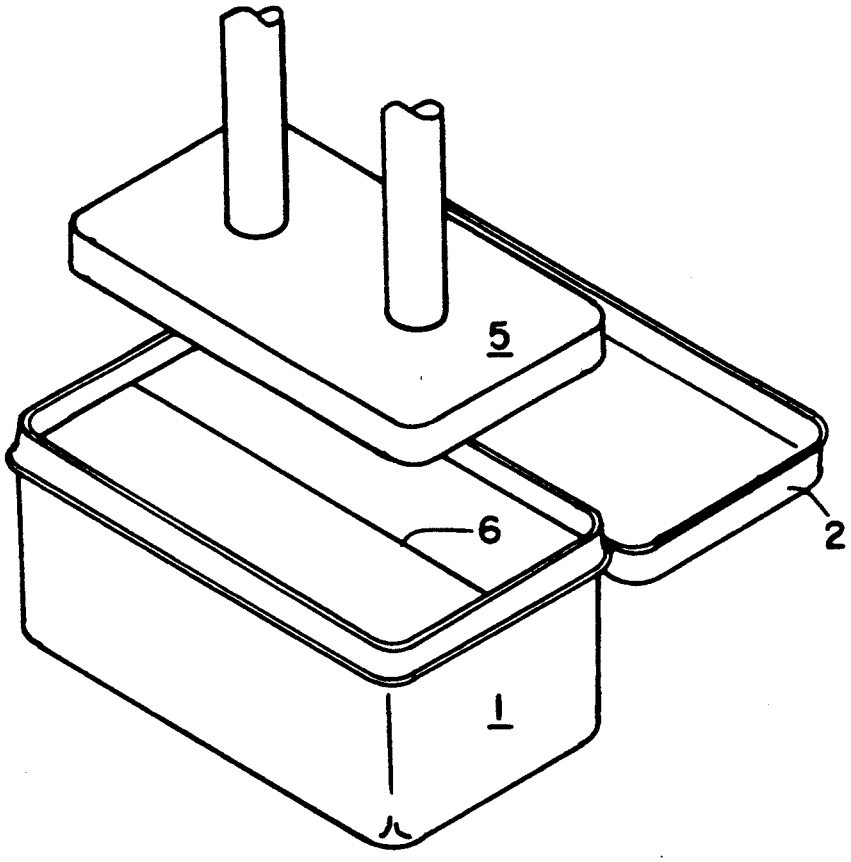
FIG. 3 is a perspective view of the tub of wet wipes and the compression foot as illustrated in FIG. 2.

FIG. 3 illustrates in a perspective view the stack of wipes within the tub 1 and the compression foot 5 as shown in FIG. 2. Also shown in this figure is the z-folded edge 6 of the top wipe of the stack.

EXAMPLE

In order to illustrate the benefit of the method of this invention, stacks of wet wipes were subjected to different levels of compression prior to being enclosed within the dispensing container. All of the wipes were dispensed from the top of the container by the tester reaching in and grasping the top wipe. The number of occurrences in which two wipes instead of one were removed or in which a wipe was removed in a less than fully open condition was noted and recorded as a defect. Each of the stacks contained 120 individual wet wipes (fifteen clips of eight). The wet wipe basesheet was a 70 grams per square meter basis weight coform sheet (55 weight percent pulp and 45 weight percent polypropylene). The wipes were manufactured as described in FIG. 1, wherein the basesheet was impregnated with the wet wipe solution, slit into ribbons having a width of 7.5 inches, z-folded and combined into a sausage. The sausage was cut into lengths of 7.6 inches to form clips of eight z-folded wipes. Fifteen clips were combined into a stack of 120 wipes, which was inserted into a tub. The liquid add-on was about 320 weight percent, based on the dry weight of the basesheet. The surface area of the top of each stack tested was about 30 square inches (3.8×7.6 inches). A plexiglass plate which completely covered the surface of the top of each stack was used to compress the stack to the desired level. The results are tabulated below, listing the total pressure force exerted on the top of the stack by the glass plate, expressed in pounds, as well as the calculated pressure expressed in pounds per square inch in parentheses:

| Compression | Defects | Compression | Defects |
|---|---|---|---|
| 0 (0) | 14 | 55 (1.83) | 9 |
| 5 (0.17) | 14 | 60 (2.00) | 12 |
| 10 (0.33) | 14 | 65 (2.17) | 6 |
| 15 (0.50) | 14 | 70 (2.33) | 7 |
| 20 (0.67) | 13 | 75 (2.50) | 11 |
| 25 (0.83) | 13 | 80 (2.67) | 1 |
| 30 (1.00) | 13 | 85 (2.83) | 8 |
| 35 (1.17) | 14 | 90 (3.00) | 7 |
| 40 (1.33) | 12 | 95 (3.17) | 6 |
| 45 (1.50) | 10 | 100 (3.33) | 4 |
| 50 (1.67) | 11 | 110 (3.66) | 1 |

These results illustrate the improvement in one-at-a-time, fully-open dispensing of the wipes resulting from the increasing compression of the wet wipe stack from about 0.5 pounds per square inch to about 3.5 pounds per square inch or greater.

It will be appreciated that the foregoing description, given for purposes of illustration, is not to be construed as limiting the scope of this invention, which includes all equivalents thereto.

I claim:

1. In a method for making a stack of wet wipes comprising the steps of forming two or more clips of individual wet wipes and combining the individual clips into a stack of wet wipes, the improvement comprising compressing the stack of wet wipes sufficiently to increase the degree of adhesion between adjacent wipes of adjacent clips.

2. The method of claim 1 wherein the amount of compression is about 0.5 pounds per square inch or greater.

3. The method of claim 1 wherein the amount of compression is about 1.8 pounds per square inch or greater.

4. The method of claim 1 wherein the amount of compression is about 2.6 pounds per square inch or greater.

5. The method of claim 1 wherein the amount of compression is about 3.5 pounds per square inch or greater.

6. The method of claim 1 wherein the stack is compressed with a compression foot having a roughened or bumpy surface which substantially eliminates sticking of the wipes to the surface.

7. The method of claim 6 wherein the surface of the compression foot is a plasma coated surface.

8. The method of claim 1 wherein the stack of wet wipes is compressed by compressing substantially the entire surface of the top of the stack.

* * * * *